US008526574B2

(12) United States Patent
Wang et al.

(10) Patent No.: US 8,526,574 B2
(45) Date of Patent: Sep. 3, 2013

(54) CAPACITOR AC POWER COUPLING ACROSS HIGH DC VOLTAGE DIFFERENTIAL

(75) Inventors: Dongbing Wang, Lathrop, CA (US); Dave Reynolds, Orem, UT (US)

(73) Assignee: Moxtek, Inc., Orem, UT (US)

( * ) Notice: Subject to any disclaimer, the term of this patent is extended or adjusted under 35 U.S.C. 154(b) by 305 days.

(21) Appl. No.: 12/890,325

(22) Filed: Sep. 24, 2010

(65) Prior Publication Data

US 2012/0076276 A1 Mar. 29, 2012

(51) Int. Cl.
*H05G 1/20* (2006.01)
*H05G 1/10* (2006.01)

(52) U.S. Cl.
USPC ..... 378/107; 378/101; 378/105

(58) Field of Classification Search
USPC ..... 378/101, 102, 103, 104, 105, 106, 378/107, 108, 109, 110, 111, 112
See application file for complete search history.

(56) References Cited

U.S. PATENT DOCUMENTS

| | | | | |
|---|---|---|---|---|
| 1,946,288 | A | 2/1934 | Kearsley | |
| 2,291,948 | A | 8/1942 | Cassen | |
| 2,316,214 | A | 4/1943 | Atlee et al. | |
| 2,329,318 | A | 9/1943 | Atlee et al. | |
| 2,683,223 | A | 7/1954 | Hosemann | |
| 2,952,790 | A | 9/1960 | Steen | |
| 3,218,559 | A | 11/1965 | Applebaum | |
| 3,356,559 | A | 12/1967 | Mohn et al. | |
| 3,434,062 | A | 3/1969 | Cox | |
| 3,679,927 | A | 7/1972 | Kirkendall | |
| 3,801,847 | A | 4/1974 | Dietz | |
| 3,828,190 | A | 8/1974 | Dahlin et al. | |
| 3,851,266 | A | 11/1974 | Conway | |
| 3,872,287 | A | 3/1975 | Kooman | |
| 3,882,339 | A | 5/1975 | Rate et al. | |
| 3,894,219 | A | 7/1975 | Weigel | |
| 4,007,375 | A | 2/1977 | Albert | |
| 4,075,526 | A | 2/1978 | Grubis | |
| 4,160,311 | A | 7/1979 | Ronde et al. | |
| 4,184,097 | A | 1/1980 | Auge | |
| 4,393,127 | A | 7/1983 | Greschner et al. | |
| 4,400,822 | A * | 8/1983 | Kuhnke et al. | 378/103 |
| 4,421,986 | A | 12/1983 | Friauf et al. | |
| 4,463,338 | A | 7/1984 | Utner et al. | |
| 4,504,895 | A | 3/1985 | Steigerwald | |

(Continued)

FOREIGN PATENT DOCUMENTS

| | | |
|---|---|---|
| DE | 10 30 936 | 5/1958 |
| DE | 44 30 623 | 3/1996 |

(Continued)

OTHER PUBLICATIONS

U.S. Appl. No. 12/239,302; filed Sep. 26, 2008; Robert C. Davis; office action issued May 26, 2011.

(Continued)

*Primary Examiner* — Allen C. Ho
(74) *Attorney, Agent, or Firm* — Thorpe North & Western LLP

(57) ABSTRACT

A circuit providing reliable voltage isolation between a low and high voltage sides of a circuit while allowing AC power transfer between the low and high voltage sides of the circuit to an x-ray tube filament. Capacitors provide the isolation between the low and high voltage sides of the circuit.

20 Claims, 7 Drawing Sheets

(56) References Cited

U.S. PATENT DOCUMENTS 4,521,902 A 6/1985 Peugeot
4,608,326 A 8/1986 Neukermans et al.
4,679,219 A 7/1987 Ozaki
4,688,241 A 8/1987 Peugeot
4,734,924 A * 3/1988 Yahata et al. ..... 378/118
4,761,804 A * 8/1988 Yahata ..... 378/109
4,777,642 A 10/1988 Ono
4,797,907 A 1/1989 Anderton
4,819,260 A 4/1989 Haberrecker
4,870,671 A 9/1989 Hershyn
4,891,831 A 1/1990 Tanaka et al.
4,969,173 A 11/1990 Valkonet
4,979,198 A 12/1990 Malcolm et al.
4,995,069 A * 2/1991 Tanaka ..... 378/200
5,010,562 A 4/1991 Hernandez et al.
5,063,324 A 11/1991 Grunwald
5,066,300 A 11/1991 Isaacson et al.
5,077,771 A 12/1991 Skillicorn et al.
5,077,777 A 12/1991 Daly
5,090,046 A 2/1992 Friel
5,105,456 A 4/1992 Rand et al.
5,117,829 A 6/1992 Miller et al.
5,153,900 A 10/1992 Nomikos et al.
5,161,179 A 11/1992 Suzuki et al.
5,178,140 A 1/1993 Ibrahim
5,187,737 A * 2/1993 Watanabe ..... 378/105
5,200,984 A * 4/1993 Laeuffer ..... 378/110
5,226,067 A 7/1993 Allred et al.
RE34,421 E 10/1993 Parker et al.
5,267,294 A 11/1993 Kuroda et al.
5,343,112 A 8/1994 Wegmann
5,347,571 A * 9/1994 Furbee et al. ..... 378/105
5,391,958 A 2/1995 Kelly
5,400,385 A 3/1995 Blake et al.
5,422,926 A 6/1995 Smith et al.
5,428,658 A 6/1995 Oettinger et al.
5,469,429 A 11/1995 Yamazaki et al.
5,469,490 A 11/1995 Golden et al.
5,478,266 A 12/1995 Kelly
RE35,383 E 11/1996 Miller et al.
5,578,360 A 11/1996 Biitanen
5,621,780 A 4/1997 Smith et al.
5,627,871 A 5/1997 Wang
5,631,943 A 5/1997 Miles
5,680,433 A 10/1997 Jensen
5,682,412 A 10/1997 Skillicorn et al.
5,696,808 A 12/1997 Lenz
5,729,583 A 3/1998 Tang et al.
5,812,632 A 9/1998 Schardt et al.
5,907,595 A 5/1999 Sommerer
5,978,446 A * 11/1999 Resnick ..... 378/105
6,005,918 A 12/1999 Harris et al.
6,044,130 A 3/2000 Inazura et al.
6,069,278 A 5/2000 Chuang
6,073,484 A 6/2000 Miller et al.
6,075,839 A 6/2000 Treseder
6,097,790 A 8/2000 Hasegawa et al.
6,129,901 A 10/2000 Moskovits et al.
6,133,401 A 10/2000 Jensen
6,134,300 A 10/2000 Trebes et al.
6,184,333 B1 2/2001 Gray
6,205,200 B1 3/2001 Boyer et al.
6,277,318 B1 8/2001 Bower
6,282,263 B1 8/2001 Arndt et al.
6,288,209 B1 9/2001 Jensen
6,307,008 B1 10/2001 Lee et al.
6,320,019 B1 11/2001 Lee et al.
6,351,520 B1 2/2002 Inazaru
6,385,294 B2 5/2002 Suzuki et al.
6,388,359 B1 5/2002 Duelli et al.
6,438,207 B1 8/2002 Chidester et al.
6,477,235 B2 11/2002 Chornenky et al.
6,487,272 B1 11/2002 Kutsuzawa
6,487,273 B1 11/2002 Takenaka et al.
6,494,618 B1 12/2002 Moulton
6,546,077 B2 4/2003 Chornenky et al.
6,567,500 B2 5/2003 Rother
6,658,085 B2 12/2003 Sklebitz et al.
6,661,876 B2 12/2003 Turner et al.
6,740,874 B2 5/2004 Doring
6,778,633 B1 8/2004 Loxley et al.
6,799,075 B1 9/2004 Chornenky et al.
6,803,570 B1 10/2004 Bryson, III et al.
6,816,573 B2 11/2004 Hirano et al.
6,819,741 B2 11/2004 Chidester
6,852,365 B2 2/2005 Smart et al.
6,866,801 B1 3/2005 Mau et al.
6,876,724 B2 4/2005 Zhou
6,956,706 B2 10/2005 Brandon
6,976,953 B1 12/2005 Pelc
6,987,835 B2 1/2006 Lovoi
7,035,379 B2 4/2006 Turner et al.
7,046,767 B2 5/2006 Okada et al.
7,049,735 B2 5/2006 Ohkubo et al.
7,050,539 B2 5/2006 Loef et al.
7,075,699 B2 7/2006 Oldham et al.
7,085,354 B2 8/2006 Kanagami
7,108,841 B2 9/2006 Smalley
7,110,498 B2 9/2006 Yamada
7,130,380 B2 10/2006 Lovoi et al.
7,130,381 B2 10/2006 Lovoi et al.
7,203,283 B1 4/2007 Puusaari
7,206,381 B2 4/2007 Shimono et al.
7,215,741 B2 5/2007 Ukita
7,224,769 B2 5/2007 Turner
7,233,647 B2 6/2007 Turner et al.
7,286,642 B2 10/2007 Ishikawa et al.
7,305,066 B2 12/2007 Ukita
7,317,784 B2 1/2008 Durst et al.
7,358,593 B2 4/2008 Smith et al.
7,382,862 B2 6/2008 Bard et al.
7,428,298 B2 9/2008 Bard et al.
7,448,801 B2 11/2008 Oettinger et al.
7,448,802 B2 11/2008 Oettinger et al.
7,486,774 B2 2/2009 Cain
7,526,068 B2 4/2009 Dinsmore
7,529,345 B2 5/2009 Bard et al.
7,634,052 B2 12/2009 Grodzins et al.
7,649,980 B2 1/2010 Aoki
7,650,050 B2 1/2010 Haffner et al.
7,657,002 B2 2/2010 Burke et al.
7,675,444 B1 3/2010 Smith et al.
7,680,652 B2 3/2010 Giesbrecht et al.
7,693,265 B2 4/2010 Hauttmann et al.
7,709,820 B2 5/2010 Decker et al.
7,737,424 B2 6/2010 Xu et al.
7,756,251 B2 7/2010 Davis et al.
2003/0096104 A1 5/2003 Tobita et al.
2003/0152700 A1 8/2003 Asmussen et al.
2003/0165418 A1 9/2003 Ajayan et al.
2004/0076260 A1 4/2004 Charles, Jr. et al.
2005/0018817 A1 1/2005 Oettinger et al.
2005/0141669 A1 6/2005 Shimono et al.
2005/0207537 A1 9/2005 Ukita
2006/0073682 A1 4/2006 Furukawa et al.
2006/0098778 A1 5/2006 Oettinger et al.
2006/0210020 A1 9/2006 Takahashi et al.
2006/0233307 A1 10/2006 Dinsmore
2006/0269048 A1 11/2006 Cain
2006/0280289 A1 12/2006 Hanington et al.
2007/0025516 A1 2/2007 Bard et al.
2007/0111617 A1 5/2007 Meilahti
2007/0172104 A1 7/2007 Nishide
2007/0183576 A1 8/2007 Burke et al.
2007/0217574 A1 9/2007 Beyerlein
2008/0296479 A1 12/2008 Anderson et al.
2008/0296518 A1 12/2008 Xu et al.
2008/0317982 A1 12/2008 Hecht
2009/0085426 A1 4/2009 Davis et al.
2009/0086923 A1 4/2009 Davis et al.
2009/0213914 A1 8/2009 Dong et al.
2009/0243028 A1 10/2009 Dong et al.

| | | | |
|---|---|---|---|
| 2010/0126660 | A1 | 5/2010 | O'Hara |
| 2010/0189225 | A1 | 7/2010 | Ernest et al. |
| 2010/0285271 | A1 | 11/2010 | Davis et al. |

FOREIGN PATENT DOCUMENTS

| | | |
|---|---|---|
| DE | 19818057 | 11/1999 |
| EP | 0 297 808 | 1/1989 |
| EP | 0330456 | 8/1989 |
| GB | 1252290 | 11/1971 |
| JP | 57 082954 | 8/1982 |
| JP | 3170673 | 7/1991 |
| JP | 4171700 | 6/1992 |
| JP | 5066300 | 3/1993 |
| JP | 5135722 | 6/1993 |
| JP | 06 119893 | 7/1994 |
| JP | 6289145 | 10/1994 |
| JP | 08315783 | 11/1996 |
| JP | 2003/007237 | 1/2003 |
| JP | 2003211396 | 7/2003 |
| JP | 2006297549 | 11/2008 |
| KR | 1020050107094 | 11/2005 |
| WO | WO96/19738 | 6/1996 |
| WO | WO2008/052002 | 5/2008 |

OTHER PUBLICATIONS

Vajtai et al.; Building Carbon Nanotubes and Their Smart Architecutes; Smart Mater. Struct.; 2002; pp. 691-698; vol. 11.

PCT Application PCT/US2011/046371; filed Aug. 3, 2011; Steven Liddiard; International Search Report mailed Feb. 29, 2012.

PCT Application PCT/US2010/056011; filed Nov. 9, 2010; Krzysztof Kozaczek; International Search Report mailed Jul. 13, 2011.

Chakrapani et al.; Capillarity-Driven Assembly of Two-Dimensional Cellular Carbon Nanotube Foams; PNAS; Mar. 23, 2004; pp. 4009-4012; vol. 101; No. 12.

Chen, Xiaohua et al., "Carbon-nanotube metal-matrix composites prepared by electroless plating," Composites Science and Technology, 2000, pp. 301-306, vol. 60.

Flahaut, E. et al, "Carbon Nanotube-metal-oxide nanocomposites; microstructure, electrical conductivity and mechanical properties," Acta mater., 2000, pp. 3803-3812.Vo. 48.

Gevin et al., "IDeF-X V1.0: performances of a new CMOS multi channel analogue readout ASIC for Cd(Zn)Te detectors", IDDD Oct. 2005, 433-437, vol. 1.

Grybos et al., "DEDIX—development of fully integrated multichannel ASCI for high count rate digital x-ray imaging systems", IEEE, 693-696, vol. 2.

Grybos et al., "Measurements of matching and high count rate performance of mulitchannel ASIC for digital x-ray imaging systems", IEEE, Aug. 2007, 1207-1215, vol. 54, Issue 4.

Grybos et al., "Pole-Zero cancellation circuit with pulse pile-up tracking system for low noise charge-sensitive amplifiers", Feb. 2008, 583-590, vol. 55, Issue 1.

http://www.orau.org/ptp/collectio/xraytubescollidge/MachlettCW250T.htm, 1999, 2 pages.

Hutchison, "Vertically aligned carbon nanotubes as a framework for microfabrication of high aspect ration mems," 2008, pp. 1-50.

Jiang, Linquin et al., "Carbon nanotubes-metal nitride composites; a new class of nanocomposites with enhanced electrical properties," J. Mater. Chem., 2005, pp. 260-266, vol. 15.

Li, Jun et al., "Bottom-up approach for carbon nanotube interconnects," Applied Physics Letters, Apr. 14, 2003, pp. 2491-2493, vol. 82 No. 15.

Ma. R.Z., et al., "Processing and properties of carbon nanotubes-nano-SIC ceramic", Journal of Materials Science 1998, pp. 5243-5246, vol. 33.

Micro X-ray Tube Operation Manual, X-ray and Specialty Instruments Inc., 1996, 5 pages.

Peigney, et al., "Carbon nanotubes in novel ceramic matrix nanocomposites," Ceramics International, 2000, pp. 677-683, vol. 26.

Rankov et al., "A novel correlated double sampling poly-Si circuit for readout systems in large area x-ray sensors", IEEE, May 2005, 728-731, vol. 1.

Satishkumar B.C., et al. "Synthesis of metal oxide nanorods using carbon nanotubes as templates," Journal of Materials Chemistry, 2000, pp. 2115-2119, vol. 10.

Sheather, "The support of thin windows for x-ray proportional counters," Journal Phys,E., Apr. 1973, pp. 319-322, vol. 6, No. 4.

Tamura et al., "Development of ASICs for CdTe pixel and line sensors", Oct. 2005, 2023-2029, vol. 52, Issue 5.

Wagner et al., "Effects of scatter in dual-energy imaging: an alternative analysis", Sep. 1989, 236-244, vol. 8, Issue 3.

Yan, Xing-Bin, et al., Fabrications of Three-Dimensional ZnO-Carbon Nanotube (CNT) Hybrids Using Self-Assembled CNT Micropatterns as Framework, 2007. pp. 17254-17259, vol. III.

PCT Application PCT/US2011/044168; filing date Jul. 15, 2011; Dongbing Wang; International Search Report mailed Mar. 28, 2012.

U.S. Appl. No. 12/640,154, filed Dec. 17, 2009; Krzysztof Kozaczek; office action issued Jun. 9, 2011.

U.S. Appl. No. 12/407,457, filed Mar. 19, 2009; Sterling W. Cornaby; office action issued Jun. 14, 2011.

Vajtai et al.; Building Carbon Nanotubes and Their Smart Architectures; Smart Mater. Struct.; 2002; vol. 11; pp. 691-698.

U.S. Appl. No. 12/239,302, filed Sep. 26, 2008; Robert C. Davis; office action issued May 26, 2011.

U.S. Appl. No. 12/640,154, filed Dec. 17, 2009; Krzysztof Kozaczek; notice of allowance issued May 23, 2011.

* cited by examiner

CAPACITOR AC POWER COUPLING ACROSS HIGH DC VOLTAGE DIFFERENTIAL

BACKGROUND

In certain applications, there is a need to transfer alternating current (AC) power from an AC power source to a load in a circuit in which there is a very large direct current (DC) voltage differential between the AC power source and the load. A transformer is often used in such applications for isolating the AC power source from the load.

For example, in an x-ray tube, a cathode is electrically isolated from an anode. A power supply can provide a DC voltage differential between the cathode and the anode of typically about 4-150 kilovolts (kV). This very large voltage differential between the cathode and the anode provides an electric field for accelerating electrons from the cathode to the anode. The cathode can include a cathode element for producing electrons. The cathode element is a load in the circuit. A power supply can also provide an alternating current to the cathode element in order to heat the cathode element for electron emission from the cathode element. For instance, the alternating current may be supplied by a separate power supply or an AC power source embedded with the DC power supply.

There is a very large DC voltage differential between the AC power source and the cathode element, such as about 4-150 kilovolts (kV). The AC power source can be part of a low voltage side of the circuit and the cathode element can be part of a high voltage side of the circuit. A transformer is normally used to isolate the AC power source from the cathode element, or in other words the transformer can isolate the low voltage side of the circuit from the high DC voltage side of the circuit.

Due to the very high DC voltage differential between the AC power source and the load, arcing can occur at the transformer between the wires on the low voltage side of the transformer and the wires on the high voltage side of the transformer. Such arcing can reduce or destroy the DC voltage differential and thus reduce or destroy cathode electron emission and electron acceleration between the cathode and the anode. Although increased wire insulation can help to reduce this problem, defects in the wiring insulation can result in arcing. Also, due to space constraints, especially in miniature x-ray tubes, increased wiring insulation may not be feasible.

SUMMARY

It has been recognized that it would be advantageous to transfer AC power from an AC power source to a load in a circuit in which there is a very large DC voltage differential between the AC power source and the load without the use of a transformer and without problems of arcing between the two sides of the circuit.

The present invention is directed to a circuit for supplying AC power to a load in a circuit in which there is a large DC voltage differential between an AC power source and the load. Capacitors are used to provide voltage isolation while providing efficient transfer of AC power from the AC power source to the load. The DC voltage differential can be at least about 1 kV. This invention satisfies the need for reliably and efficiently transferring AC power across a large DC voltage differential.

The present invention can be used in an x-ray tube in which (1) the load can be a cathode element which is electrically isolated from an anode, and (2) there exists a very large DC voltage differential between the cathode element and the anode. AC power supplied to the cathode element can heat the cathode and due to such heating, and the large DC voltage differential between the cathode element and the anode, electrons can be emitted from the cathode element and propelled towards the anode.

DEFINITIONS

Figure 1:
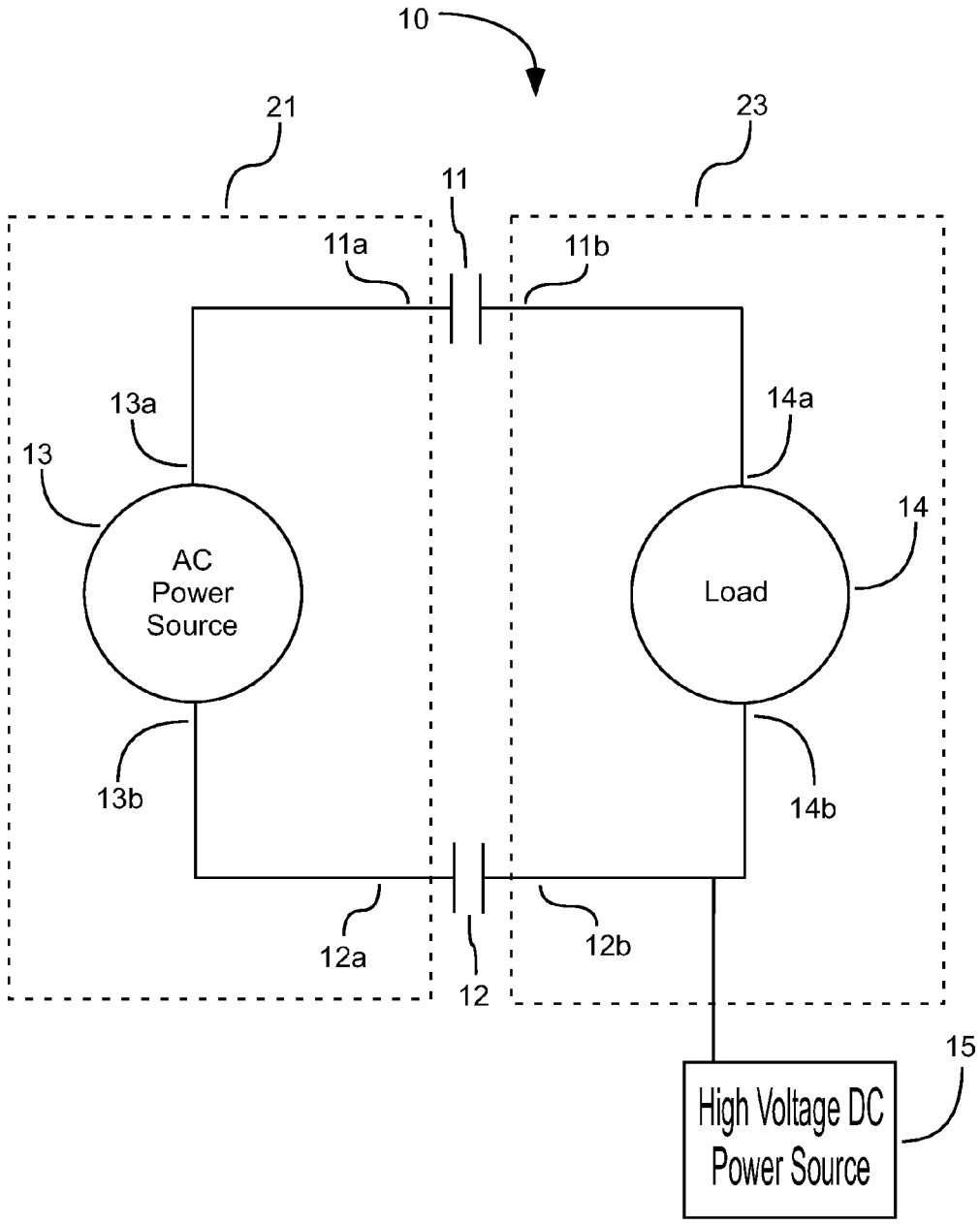
FIG. 1 is a schematic of a circuit for supplying alternating current to a load, with a high voltage DC power source on the load side of the circuit, in accordance with an embodiment of the present invention.

As used in this description and in the appended claims, the following terms are defined

- As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.
- As used herein, the term "about" is used to provide flexibility to a numerical range endpoint by providing that a given value may be "a little above" or "a little below" the endpoint.
- As used herein, the term "capacitor" means a single capacitor or multiple capacitors in series.
- As used herein, the term "high voltage" or "higher voltage" refer to the DC absolute value of the voltage. For example, negative 1 kV and positive 1 kV would both be considered to be "high voltage" relative to positive or negative 1 V. As another example, negative 40 kV would be considered to be "higher voltage" than 0 V.

As used herein, the term "low voltage" or "lower voltage" refer to the DC absolute value of the voltage. For example, negative 1 V and positive 1 V would both be considered to be "low voltage" relative to positive or negative 1 kV. As another example, positive 1 V would be considered to be "lower voltage" than 40 kV.

DETAILED DESCRIPTION

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIG. 1, a circuit, shown generally at 10, for supplying AC power to a load 14, includes an AC power source 13 having a first connection 13*a* and a second connection 13*b*, a first capacitor 11 having a first connection 11*a* and a second connection 11*b*, and a second capacitor 12 having a first connection 12*a* and a second connection 12*b*. The first connection 13*a* of the AC power source 13 is connected to the first connection 11*a* on the first capacitor 11. The second connection 13*b* of the AC power source 13 is connected to the first connection 12*a* on the second capacitor 12. The AC power source 13, the first and second connections on the AC power source 13*a-b*, the first connection 11*a* on the first capacitor 11, and the first connection 12*a* on the second capacitor 12 comprise a first voltage side 21 of the circuit.

The circuit 10 for supplying AC power to a load further comprises the load 14 having a first connection 14*a* and a second connection 14*b*. The second connection 11*b* of the first capacitor 11 is connected to the first connection 14*a* on the load 14 and the second connection 12*b* of the second capacitor 12 is connected to the second connection 14*b* on the load 14. The load 14, the first and second connections on the load 14*a-b*, the second connection 11*b* on the first capacitor 11, and the second connection 12*b* on the second capacitor 12 comprise a second voltage side 23 of the circuit.

The first and second capacitors 11, 12 provide voltage isolation between the first and second voltage sides 21, 23 of the circuit, respectively. A high voltage DC source can provide at least 1 kV DC voltage differential between the first 21 and second 23 voltage sides of the circuit.

Figure 2:
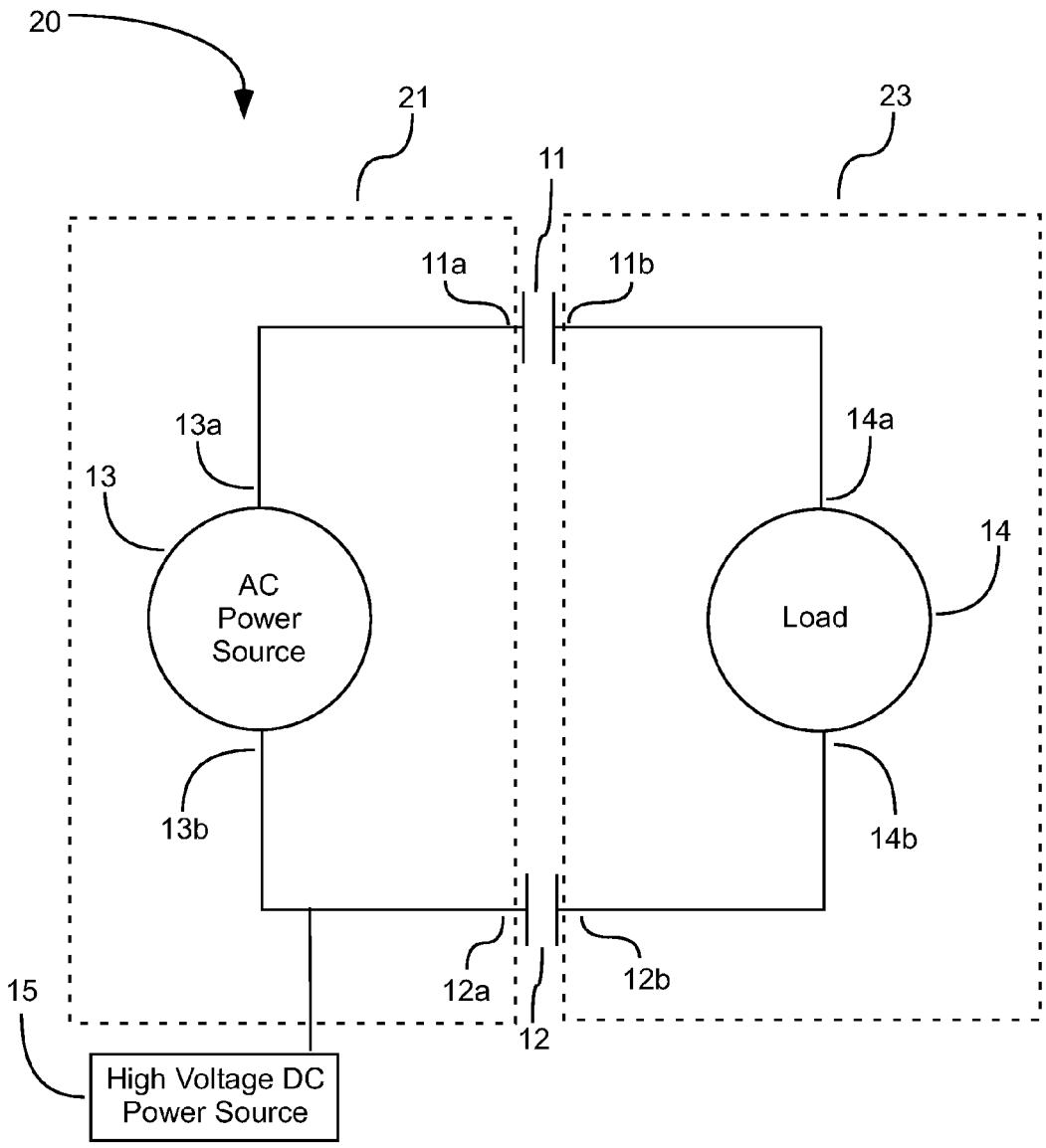
FIG. 2 is a schematic of a circuit for supplying alternating current to a load, with a high voltage DC power source on the AC power source side of the circuit, in accordance with an embodiment of the present invention.
Figure 3:
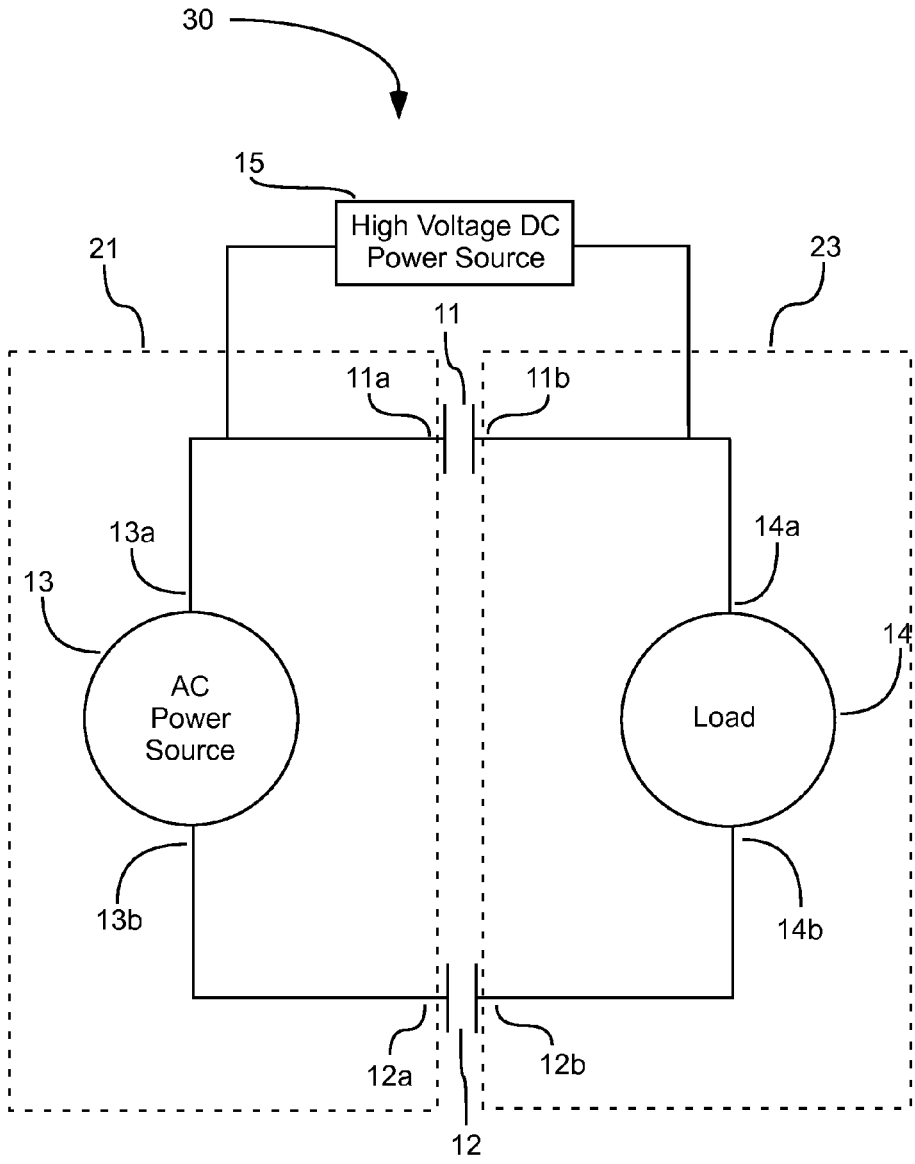
FIG. 3 is a schematic of a circuit for supplying alternating current to a load, with a high voltage DC power source connected between the load side of the circuit and the AC power source side of the circuit, in accordance with an embodiment of the present invention.

As shown in FIG. 1, the high voltage DC power source 15 can be electrically connected to the second voltage side 23 of the circuit 10, such that the second voltage side of the circuit is a substantially higher voltage than the first voltage side 21 of the circuit. Alternatively, as shown in FIG. 2, the high voltage DC power source 15 can be electrically connected to the first voltage side 21 of the circuit 20, such that the first voltage side of the circuit has a substantially higher voltage than the second voltage side 23 of the circuit. As shown in FIG. 3, the high voltage DC power source 15 can be electrically connected between the first 21 and second 23 voltage sides of the circuit 30 to provide a large DC voltage potential between the two sides of the circuit.

The DC voltage differential between the first 21 and second 23 voltage sides of the circuit can be substantially greater than 1 kV. For example the DC voltage differential between the first and second voltage sides of the circuit can be greater than about 4 kV, greater than about 10 kV, greater than about 20 kV, greater than about 40 kV, or greater than about 60 kV.

The AC power source 13 can transfer at least about 0.1 watt, at least about 0.5 watt, at least about 1 watt, or at least about 10 watts of power to the load 14.

Sometimes a circuit such as the example circuit displayed in FIGS. 1-3 needs to be confined to a small space, such as for use in a portable tool. In such a case, it is desirable for the capacitors to have a small physical size. Capacitors with lower capacitance C are typically smaller in physical size. However, use of a capacitor with a lower capacitance can also result in an increased capacitive reactance $X_c$. A potential increase in capacitive reactance $X_c$ due to lower capacitance C of the capacitors can be compensated for by increasing the frequency f supplied by the AC power source, as shown in the formula:

$$X_c = \frac{1}{2 * pi * f * C}.$$

In selected embodiments of the present invention, the capacitance of the first and second capacitors can be greater than about 10 pF or in the range of about 10 pF to about 1 μF. In selected embodiments of the present invention the alternating current may be supplied to the circuit 10 at a frequency f of at least about 1 MHz, at least about 500 MHz, or at least about 1 GHz.

For example, if the capacitance C is 50 pF and the frequency f is 1 GHz, then the capacitive reactance X, is about 3.2. In selected embodiments of the present invention, the capacitive reactance X, of the first capacitor 11 can be in the range of 0.2 to 12 ohms and the capacitive reactance $X_c$ of the second capacitor 12 can be in the range of 0.2 to 12 ohms.

It may be desirable, especially in very high voltage applications, to use more than one capacitor in series. In deciding the number of capacitors in series, manufacturing cost, capacitor cost, and physical size constraints of the circuit may be considered. Accordingly, the first capacitor 11 can comprise at least 2 capacitors connected in series and the second capacitor 12 can comprise at least 2 capacitors connected in series.

In one embodiment, the load 14 in the circuit 10 can be a cathode element such as a filament in an x-ray tube.

Figure 4:
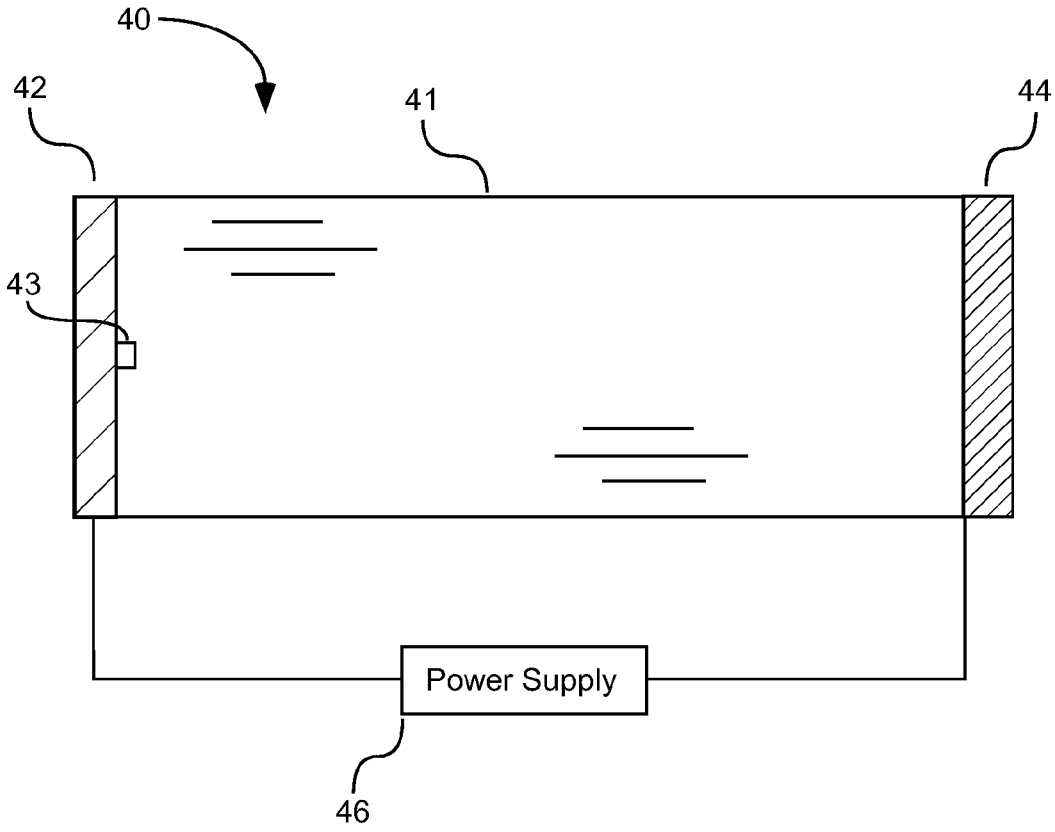
FIG. 4 is a schematic cross-sectional side view of an x-ray tube utilizing a circuit for supplying alternating current to a load in accordance with an embodiment of the present invention.

As shown in FIG. 4, the circuits 10, 20, 30 for supplying AC power to a load 14 as described above and shown in FIGS. 1-3 may be used in an x-ray tube 40. The x-ray tube 40 can comprise an evacuated dielectric tube 41 and an anode 44 that is disposed at an end of the evacuated dielectric tube 41. The anode can include a material that is configured to produce x-rays in response to the impact of electrons, such as silver, rhodium, tungsten, or palladium. The x-ray tube further comprises a cathode 42 that is disposed at an opposite end of the evacuated dielectric tube 41 opposing the anode 44. The cathode can include a cathode element 43, such as a filament, that is configured to produce electrons which can be accelerated towards the anode 44 in response to an electric field between the anode 44 and the cathode 42.

A power supply 46 can be electrically coupled to the anode 44, the cathode 42, and the cathode element 43. The power supply 46 can include an AC power source for supplying AC power to the cathode element 43 in order to heat the cathode element, as described above and shown in FIGS. 1-3. The power supply 46 can also include a high voltage DC power source connected to at least one side of the circuit and configured to provide: (1) a DC voltage differential between the first and second voltage sides of the circuit; and (2) the electric field between the anode 44 and the cathode 42. The DC voltage differential between the first and second voltage sides of the circuit can be provided as described above and shown in FIGS. 1-3.

Figure 6:
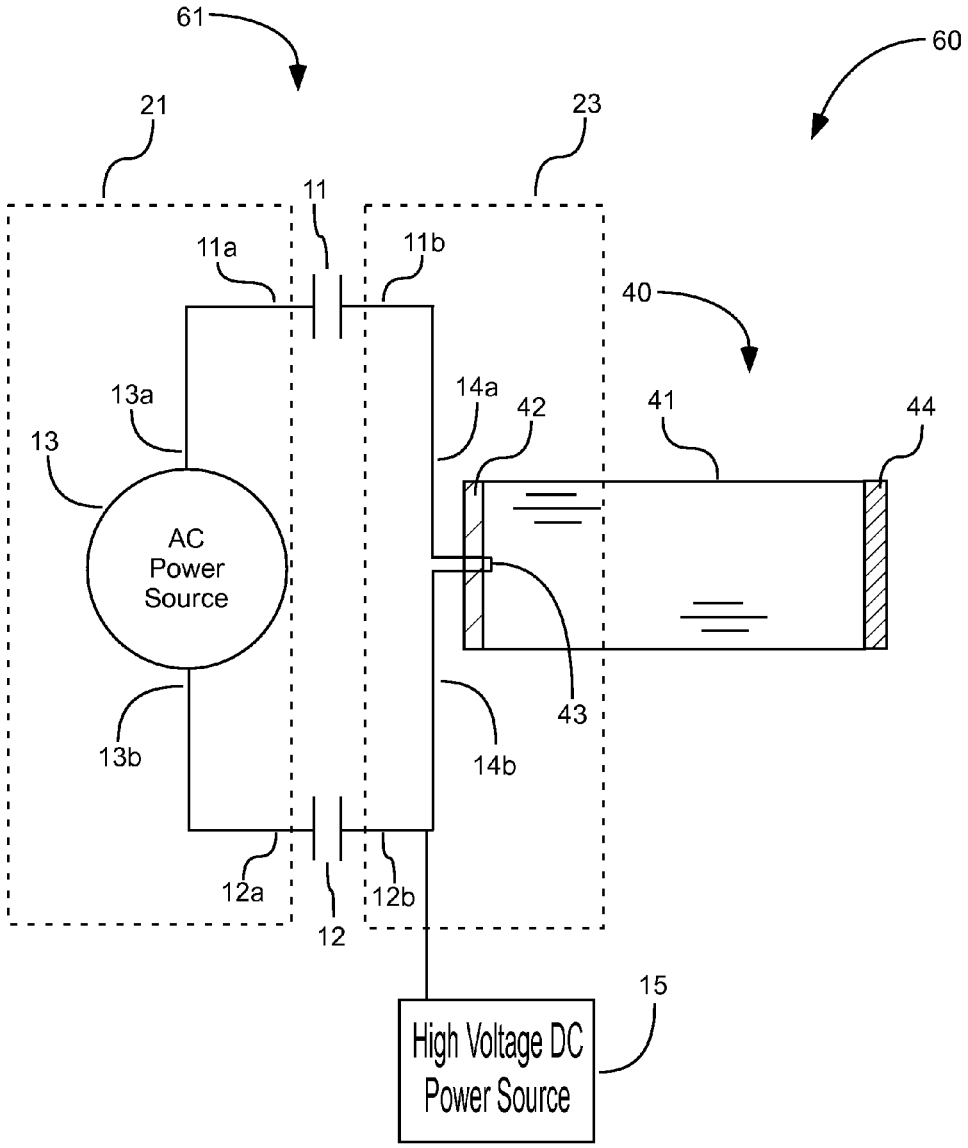
FIG. 6 is a schematic of a circuit for supplying alternating current to a load, wherein the load is an x-ray tube filament, in accordance with an embodiment of the present invention.
Figure 7:
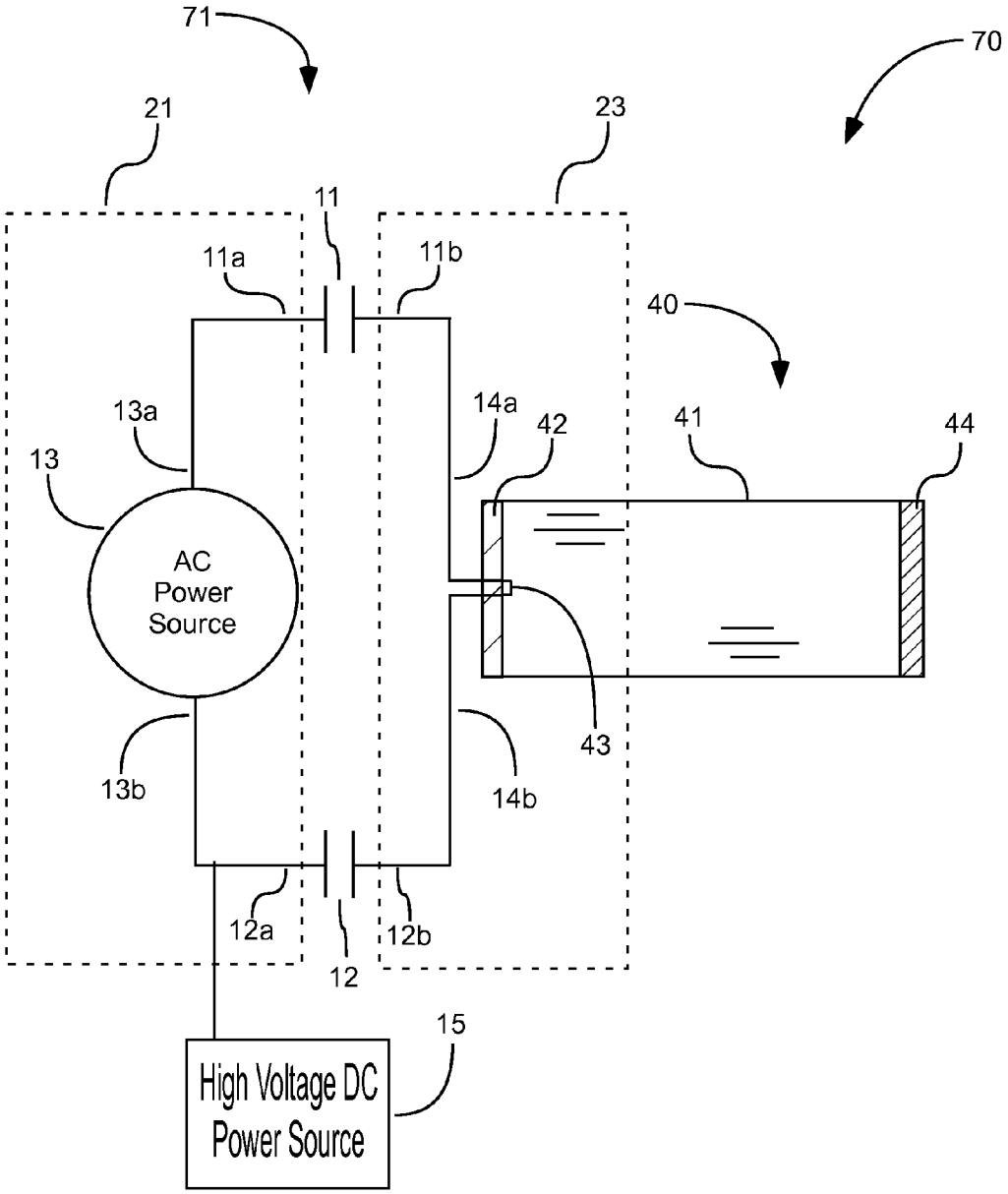
FIG. 7 is a schematic of a circuit for supplying alternating current a load, wherein the load is an x-ray tube filament, in accordance with an embodiment of the present invention.

Shown in FIG. 6 is an x-ray source 60, and shown in FIG. 7 is an x-ray source 70, comprising an evacuated dielectric tube 41; an anode 44, disposed at an end of the tube 41, including a material configured to produce x-rays in response to an impact of electrons; a cathode 42, disposed at an opposite end of the tube 41 opposing the anode 44, including a cathode element 43; and a power supply 61 electrically coupled to the cathode element 43.

The power supplies 61 and 71 comprise an alternating current (AC) circuit for supplying AC power to the cathode element 43 in order to heat the cathode element 43. The AC circuit further comprises an AC power source 13 having a first connection 13*a* and a second connection 13*b*; a first capacitor 11 having a first connection 11*a* and a second connection 11*b* and a second capacitor 12 having a first connection 12*a* and a second connection 12*b*; the first connection 13*a* of the AC power source 13 connected to the first connection 11*a* on the first capacitor 11 and the second connection 13*b* of the AC power source 13 connected to the first connection 12*a* on the second capacitor 12*b*. The AC power source 13, the first connection 11*a* on the first capacitor 11, and the first connection 12*a* on the second capacitor 12 comprise a first voltage side 21 of the circuit.

The cathode element 43 has a first connection 14*a* and a second connection 14*b*. The second connection 11*b* of the first capacitor 11 is connected to the first connection 14*a* on the cathode element 43 and the second connection 12*b* of the second capacitor 12 is connected to the second connection 14*b* on the cathode element 43. The cathode element 43, the second connection 11*b* on the first capacitor 11, and the second connection 12*b* on the second capacitor 12 comprise a second voltage side 23 of the circuit.

The first capacitor 11 and the second capacitor 12 provide voltage isolation between the first voltage side 21 and second voltage side 23 of the circuit.

The power supply 61 in FIG. 6 further comprises a high voltage direct current (DC) source 15 connected to the second voltage side 23 of the circuit. The power supply 71 in FIG. 7 further comprises a high voltage direct current (DC) source 15 connected to the first voltage side 21 of the circuit. The power supplies 61 and 71 are configured to provide a DC voltage differential between the first voltage side 21 and the second voltage side 23 of the circuit.

Methods for Providing AC Power to a Load

Figure 5:
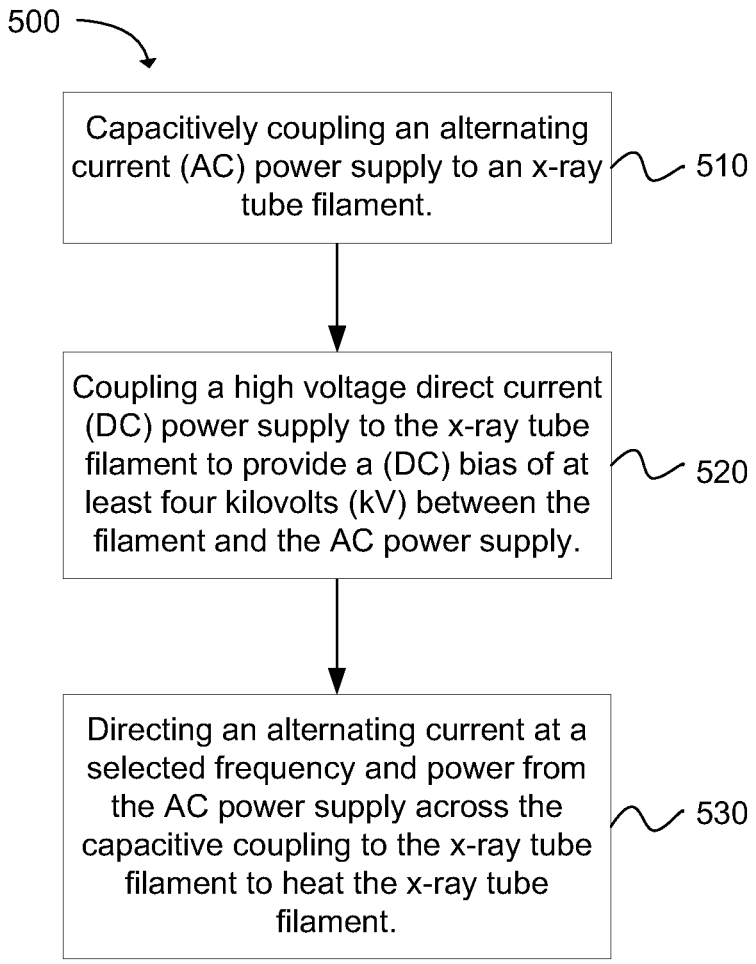
FIG. 5 is a flow chart depicting a method for heating a cathode filament in an x-ray tube in accordance with an embodiment of the present invention.

In accordance with another embodiment of the present invention, a method 500 for providing AC power to a load is disclosed, as depicted in the flow chart of FIG. 5. The method can include capacitively coupling 510 an AC power supply to a load. A high voltage DC power supply can be coupled 520 to one of the load or the AC power supply to provide a DC bias of at least 1 kV between the load and the AC power supply. The method can include directing an alternating current at a selected frequency and power can be directed from the AC power supply across the capacitive coupling to the load 530. The AC power coupled to the load can be used to heat the load. The load can be an x-ray tube cathode element, such as a filament.

The DC power supply can provide a DC voltage differential between the load and the AC power supply that is substantially higher than 1 kV. For example the DC voltage differential can be greater than about 4 kV, greater than about 20 kV, greater than about 40 kV, or greater than about 60 kV.

In various embodiments of the present invention, the power transferred to the load can be at least about 0.1 watt, at least about 0.5 watt, at least about 1 watt, or at least about 10 watts. In various embodiments of the present invention, the AC power supply can be capacitively coupled to the load with single capacitors or capacitors in series. The capacitance of the capacitors, or capacitors in series, can be greater than about 10 pF or in the range of about 10 pF to about 1 μF. In embodiments of the present invention the selected frequency may be at least about 1 MHz, at least about 500 MHz, or at least about 1 GHz.

In the above described methods, the AC power coupled to the load can be used to heat the load. The load can be an x-ray tube cathode element, such as a filament.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. An x-ray source comprising:

a) an evacuated dielectric tube;

b) an anode, disposed at an end of the tube, including a material configured to produce x-rays in response to an impact of electrons;

c) a cathode, disposed at an opposite end of the tube opposing the anode, including a cathode element;

d) a power supply electrically coupled to the cathode element;

e) the power supply comprising an alternating current (AC) circuit for supplying AC power to the cathode element in order to heat the cathode element, the AC circuit further comprising:

i) an AC power source having a first and a second connection;

ii) a first capacitor having a first connection and a second connection and a second capacitor having a first connection and a second connection;

iii) the first connection of the AC power source connected to the first connection on the first capacitor and the second connection of the AC power source connected to the first connection on the second capacitor;

iv) the AC power source, the first connection on the first capacitor, and the first connection on the second capacitor comprising a first voltage side of the circuit;

v) the cathode element having a first connection and a second connection;

vi) the second connection of the first capacitor connected to the first connection on the cathode element and the second connection of the second capacitor connected to the second connection on the cathode element;

vii) the cathode element, the second connection on the first capacitor, and the second connection on the second capacitor comprising a second voltage side of the circuit;

viii) the first and second capacitors providing voltage isolation between the first and second voltage sides of the circuit; and e) the power supply further comprising a high voltage direct current (DC) source connected to one of the first and second sides of the circuit and configured to provide a DC voltage differential between the first and second voltage sides of the circuit.

2. The x-ray source of claim 1 wherein:

a) the first voltage side of the circuit is a low voltage side of the circuit;

b) the second voltage side of the circuit is a high voltage side of the circuit;

c) the high voltage DC source is electrically connected to the high voltage side of the circuit; and d) the high voltage DC source is configured to provide at least 4 kilovolts (kV) DC voltage differential between the low voltage side and the high voltage side of the circuit.

3. The x-ray source of claim 1 wherein the first capacitor comprises at least 2 capacitors connected in series and the second capacitor comprises at least 2 capacitors connected in series.

4. The x-ray source of claim 1 wherein the capacitance of the first and second capacitor is greater than about 10 pF.

5. The x-ray source of claim 1 wherein the AC power source is configured to provide alternating current to the circuit at a frequency of at least about 1 MHz.

6. The x-ray source of claim 1 wherein the AC power source transfers at least about 0.1 watt of power to the cathode element.

7. The x-ray source of claim 1 wherein the cathode element is a filament and the AC power source transfers at least about 0.5 watt of power to the filament.

8. The x-ray source of claim 1 wherein the capacitive reactance, $X_c$, of the first capacitor is in the range of 0.2 to 12 ohms and the capacitive reactance of the second capacitor is in the range of 0.2 to 12 ohms.

9. A circuit for supplying alternating current (AC) power to a load, the circuit comprising:

a) an AC power source having a first and a second connection;

b) a first capacitor having a first connection and a second connection and a second capacitor having a first connection and a second connection;

c) the first connection of the AC power source connected to the first connection on the first capacitor and the second connection of the AC power source connected to the first connection on the second capacitor;

d) the AC power source, the first connection on the first capacitor, and the first connection on the second capacitor comprising a first voltage side of the circuit;

e) a load having a first connection and a second connection;

f) the second connection of the first capacitor connected to the first connection on the load and the second connection of the second capacitor connected to the second connection on the load;

g) the load, the second connection on the first capacitor, and the second connection on the second capacitor comprising a second voltage side of the circuit;

h) the first and second capacitors providing voltage isolation between the first and second voltage sides of the circuit; and i) a high voltage direct current (DC) source connected to the one side of the circuit and configured to provide at least 1 kilovolt (kV) DC voltage differential between the first and second voltage sides of the circuit.

10. The circuit of claim 9 wherein the capacitive reactance, $X_c$, of the first capacitor is in the range of 0.2 to 12 ohms and the capacitive reactance of the second capacitor is in the range of 0.2 to 12 ohms.

11. The circuit of claim 9 wherein the AC power source transfers at least about 0.1 watt of power to the load.

12. The circuit of claim 9 wherein the capacitance of the first and second capacitor is greater than about 10 pF.

13. The circuit of claim 9 wherein the capacitance of the first and second capacitor is in a range of about 10 pF to about 1 μF.

14. The circuit of claim 9 wherein the AC power source is configured to provide alternating current to the circuit at a frequency of at least about 1 MHz.

15. The circuit of claim 9 wherein:

a) the first voltage side of the circuit is a low voltage side of the circuit;

b) the second voltage side of the circuit is a high voltage side of the circuit; and c) the high voltage DC source is electrically connected to the high voltage side of the circuit.

16. The circuit of claim 15 wherein the high voltage DC source is configured to provide at least 10 kV voltage differential between the low voltage side and the high voltage side of the circuit.

17. The circuit of claim 9 wherein the first capacitor comprises at least 2 capacitors connected in series and the second capacitor comprises at least 2 capacitors connected in series.

18. The circuit of claim 9 wherein the load is an x-ray tube filament.

19. A circuit for supplying alternating current (AC) power to a load, the circuit comprising:

a) an AC power source having a first and a second connection;

b) a first capacitor having a first connection and a second connection and a second capacitor having a first connection and a second connection;

c) the first connection of the AC power source connected to the first connection on the first capacitor and the second connection of the AC power source connected to the first connection on the second capacitor;

d) the AC power source, the first connection on the first capacitor, and the first connection on the second capacitor comprising a first voltage side of the circuit;

e) a load having a first connection and a second connection;

f) the second connection of the first capacitor connected to the first connection on the load and the second connection of the second capacitor connected to the second connection on the load;

g) the load, the second connection on the first capacitor, and the second connection on the second capacitor comprising a second voltage side of the circuit;

h) the first and second capacitors providing voltage isolation between the first and second voltage sides of the circuit;

i) a high voltage direct current (DC) source connected to the one side of the circuit and configured to provide at least 4 kilovolts (kV) DC voltage differential between the first and second voltage sides of the circuit;

j) the AC power source transfers at least about 0.1 watts of power to the load; and k) the AC power source is configured to provide alternating current to the circuit at a frequency of at least about 1 MHz.

20. A method for heating a cathode filament in an x-ray tube, the method comprising:

a) capacitively coupling an alternating current (AC) power supply to an x-ray tube filament;

b) coupling a high voltage direct current (DC) power supply to the x-ray tube filament to provide a (DC) bias of at least four kilovolts (kV) between the filament and the AC power supply; and c) directing an alternating current at a selected frequency and power from the AC power supply across the capacitive coupling to the x-ray tube filament to heat the x-ray tube filament.

* * * * *